United States Patent [19]

Doherty

[11] 4,061,153

[45] Dec. 6, 1977

[54] PAINT ROLLER CLEANING APPARATUS

[76] Inventor: Thomas E. Doherty, 7 Carriage Lane, Setauket, N.Y. 11733

[21] Appl. No.: 727,462

[22] Filed: Sept. 28, 1976

[51] Int. Cl.[2] ..... B08B 3/02

[52] U.S. Cl. ..... 134/138; 134/149

[58] Field of Search ..... 134/138–139, 134/149, 198

[56] References Cited

U.S. PATENT DOCUMENTS

| | | | |
|---|---|---|---|
| 2,938,368 | 5/1960 | Bixel | 134/138 X |
| 3,472,251 | 10/1969 | Parker, Jr. | 134/138 |
| 3,755,840 | 9/1973 | Barger | 134/138 X |
| 3,873,364 | 3/1975 | Smith | 134/138 |
| 3,897,797 | 8/1975 | Wright et al. | 134/138 X |

FOREIGN PATENT DOCUMENTS

| | | | |
|---|---|---|---|
| 2,407,578 | 9/1974 | Germany | 134/149 |

*Primary Examiner*—Robert L. Bleutge

[57] ABSTRACT

An arrangement for cleaning paint rollers after their use. The paint roller is held between bearings within an enclosure, and is freely rotatable on said bearings. The enclosure communicates with a source of cleansing fluid which is directed through an elongated orifice along the length of the roller. The orifice in the enclosure is displaced above the axis of the roller, and the force of the cleansing fluid impinging on the surface of the roller, causes the roller to rotate and become cleansed on the surface thereof.

1 Claim, 5 Drawing Figures

PAINT ROLLER CLEANING APPARATUS

BACKGROUND OF THE INVENTION

In the use of paint rollers, it is desirable to have available provision for cleaning the paint roller after its use, so that the paint roller may be stored and used subsequently. For this purpose, it is desirable to be able to clean the roller, so that different color paints may be used in succession with the roller. Paint rollers are conventionally used for conveniently applying paint to walls, ceilings, and other large surfaces, for example.

Accordingly, it is an object of the present invention to provide a device in which a paint roller may be cleaned preparatory for subsequent reuse.

Another object of the present invention is to provide a paint roller cleaning arrangement which is simple in construction and may be fabricated at low cost.

A further object of the present invention is to provide a paint roller cleaning arrangement, as described, which may be economically maintained in service.

SUMMARY OF THE INVENTION

The objects of the present invention are achieved by providing an enclosure which holds oppositely-faced bearings between which the paint roller to be cleaned may be mounted. The mounting of the paint roller on these bearings is such that the roller is freely rotatable on the bearings.

The enclosure has an inlet communicating with a source of cleaning fluid such as water, for example, or other conventional paint cleaning fluids. The inlet communicates, furthermore, with an elongated rectangular-shaped orifice extending along the length of the roller. The orifice has a substantially narrow width, so that the cleaning fluid emerging therefrom impinges on the roller with substantial force. The orifice, moreover, is displaced above the axis of the roller so that the impinging force of the cleaning fluid results in a moment or torque which causes rotation of the roller about its bearings. The rotation of the roller, in this manner, exposes the entire surface of the roller to the cleansing fluid, and thereby the paint on the surface of the roller becomes removed.

The enclosure provides for an outlet from which the cleaning fluid may be drained after having passed over the roller surface. A hinged cover on the enclosure permits the roller to be freely inserted therein, while sealing the enclosure conveniently during cleaning of the roller.

The novel features which are considered as characteristic for the invention are set forth in particular in the appended claims. The invention itself, however, both as to its construction and its method of operation, together with additional objects and advantages thereof, will be best understood from the following description of the specific embodiments when read in connection with the accompanying drawings.

DESCRIPTION OF THE PREFERRED EMBODIMENTS

Figure 1:
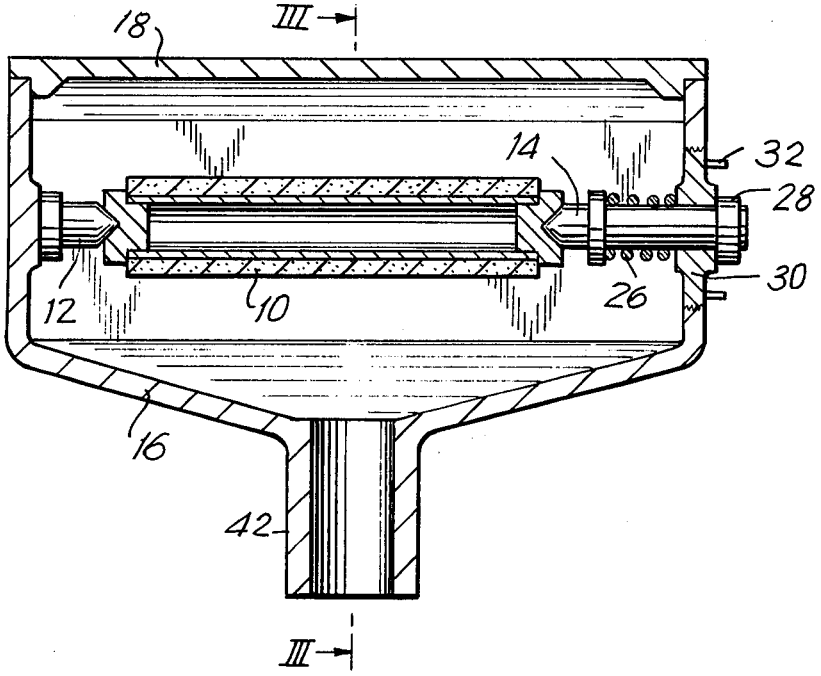
FIG. 1 is a sectional elevational view and shows the mounting of the paint roller within an enclosure during a cleaning operation, in accordance with the present invention.

Referring to the drawings, and in particular to FIG. 1, a conventional paint roller 10 is mounted between bearings 12 and 14 supported within an enclosure 16. The enclosure is provided with a hinged cover 18 which may be pivoted on the hinge 20 so as to open the enclosure for insertion of the roller. The cover 18 is provided with sealing projections 22 and 24 for the purpose of preventing the cleaning fluid from seeping through the seams of the enclosure where the cover pivots and closes.

For purposes of mounting the roller 10 in an easy manner, one of the bearings 14 is slidably arranged within the housing, and is urged against the paint roller 10 by means of a spring 26. To mount the roller in place, a bushing 28 mounted on the end of the spindle 14, is pulled away from the housing wall, so as to provide an increased distance between the bearing and thereby allow the roller to be mounted in place in a comfortable manner. Once the roller is held with axis coinciding the line joining the bearings 12 and 14, the bushing is released, and the spring 26 causes the bearing 14 to push against the roller 10 so that it is held rotatably on the bearings. The bearings are conically shaped so as to permit rotation of the roller 10 with minimum frictional resistance.

Figure 2:
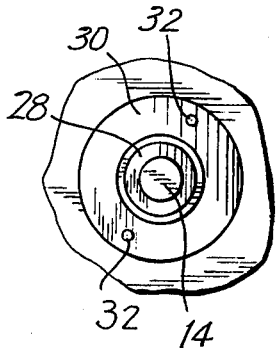
FIG. 2 is an end view of a portion of FIG. 1.

For purposes of mounting the roller within the enclosure 16, the roller may also be alternately inserted through an end of the enclosure by means of the screw cap 30 which is held within a threaded bore of the housing wall. Thus, the peripheral rim of the cap 30 shown in FIG. 2, is threaded so that it may be screwed within the threaded bore of an end wall of the housing 16. To permit manual rotation of the cap 30, pins 32 are provided on the cap along a diagonal thereof. These pins 32 may be gripped between fingers, and the cap 30 may thereby be rotated in a simple manner. The cap 30 holds, for example, the bearing assembly 14, together with the spring 26 and bushing 28. By removing the cap 30, the roller 10 may be inserted through the opening that is left in the wall of the housing, and the cap 30 can then be replaced.

Figure 3:
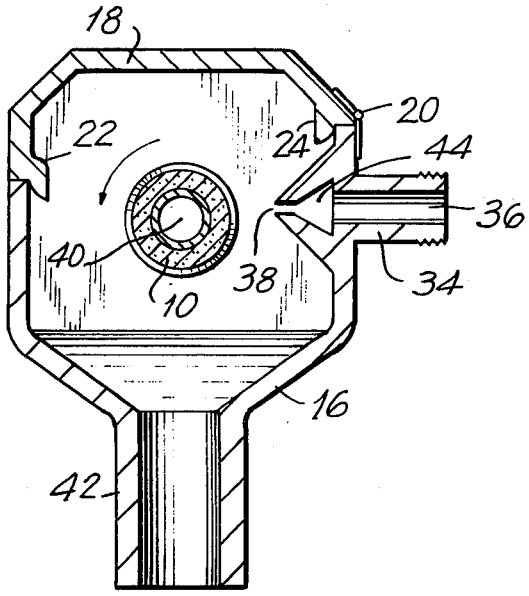
FIG. 3 is a sectional view taken along line III—III in FIG. 1.

The housing 16, is provided with an inlet 34 which may be connected to a source of cleaning fluid, such as water, for example, when latex paint is used. The cleaning fluid is directed through a duct 36, and is expelled into the housing through an opening 38 which comprises an orifice opening having an elongated rectangular shape. The elongated rectangular-shaped orifice 38 extends along the full length of the roller 10, and is situated above the axis of rotation 40 of the roller 10 on the bearings 12, 14. When fluid is directed through the duct 36, it becomes accelerated and increased in velocity through the orifice opening 38. The emerging fluid from the orifice strikes the surface of the roller above its center of rotation 40, and thereby gives rise to a moment or torque about that axis. This moment or torque causes the roller to rotate about the center 40, and thereby expose the entire surface of the roller to the impinging cleaning fluid (FIG. 3). The cleaning fluid carrying away the paint from the surface of the roller may be drained out of the housing or enclosure 16, by means of a drain 42 at the bottom thereof.

For purposes of forming a substantially high-velocity stream impinging on the surface of the roller 10, the duct 36 may terminate in a nozzle-shaped cavity 44 at the outlet of which is the orifice 38.

Figure 4:
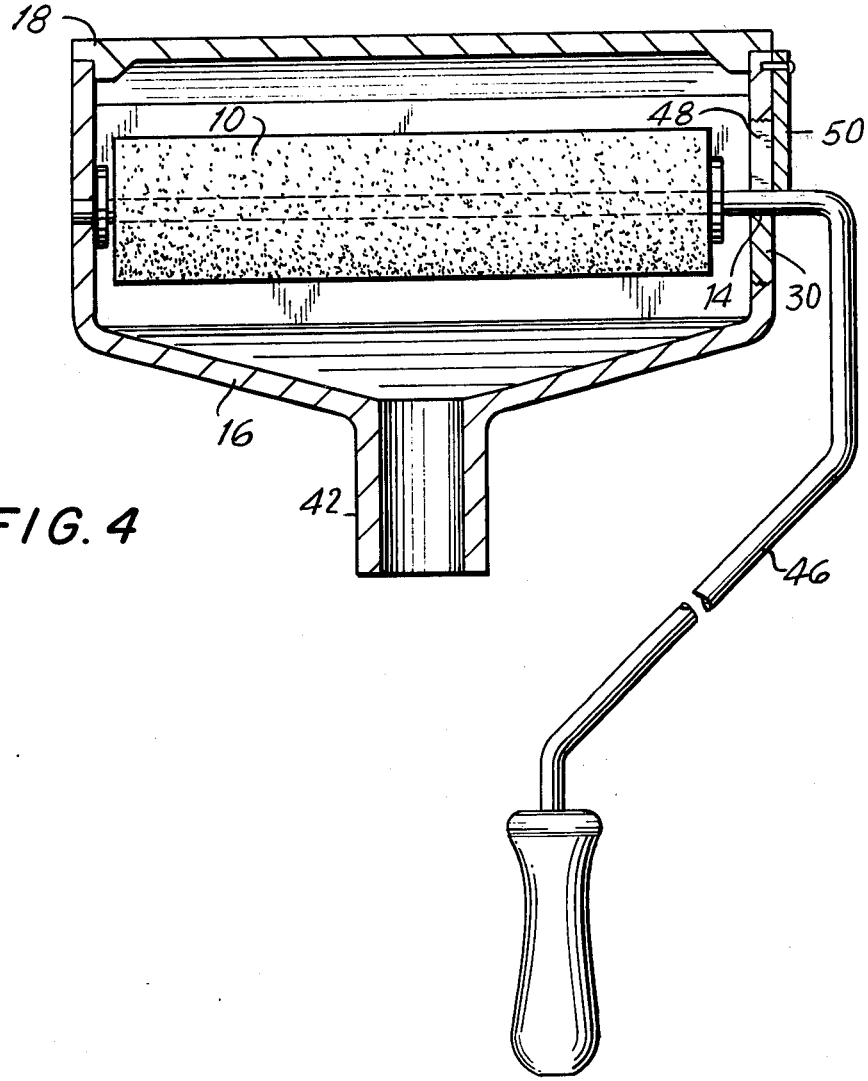
FIG. 4 is a sectional view of a paint roller mounted for cleaning with handle attached.
Figure 5:
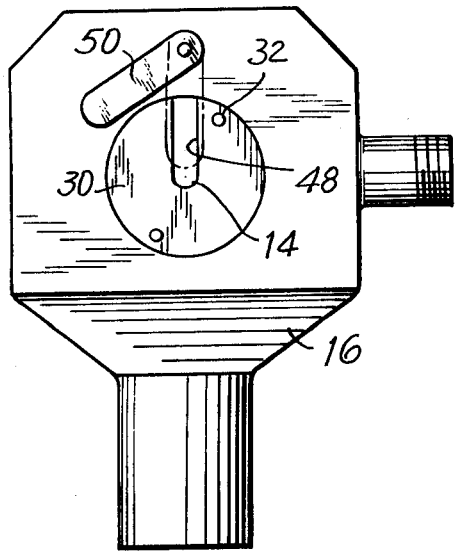
FIG. 5 is an end view of the enclosure of FIG. 1, when adapted to mounting the roller with handle shown in FIG. 4.

In the use of the paint roller, the latter is mounted on a handle 46, as shown in FIG. 4. For purposes of accommodating the roller within the housing or enclosure 16 to apply the cleaning fluid, when the handle 46 is connected to the roller, so that the roller does not have to be removed from the handle prior to cleaning, the arrangement of FIG. 5 is provided. In this construction, a slot 48 is applied to the end cap 30, which then permits the handle 46 to be assembled to the roller 10, when the latter is inserted into the enclosure or housing 16. To seal the slot 48 so that fluid cannot leak out of the slot opening when the roller is being cleaned, the closure element 50 is pivoted on the end wall containing the cap 30. After the cap 30 is screwed into place with the handle 46 projecting on the outside of the enclosure 16, the closure element 50 may be allowed to rotate abouts its pivot and drop down so as to cover the slot 48.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention, and therefore, such adaptations should and are intended to be comprehended within the meaning and range of equivalence of the following claims.

What is claimed is:

1. A paint roller cleaning arrangement comprising, in combination, a housing; bearing means within said housing for supporting rotatably a paint roller to be cleaned; cleaning fluid inlet means on said housing for admitting a stream of fluid into the interior of said housing to impinge on the surface of a roller; means for directing said stream onto said roller so that the force applied to the surface of the roller by the stream rotates the roller about said bearing means for exposing the full roller surface to said stream; said stream of cleaning fluid being directed along the full length of said roller simultaneously; centrally-located drain fluid drain means on said housing and communicating centrally with the interior of said housing for draining fluid therefrom after passing over the surface of said roller, fluid to be drained being collected centrally within the interior of said housing and being directed through said drain means; elongated rectangular — shaped orifice means on said inlet means and extending along the length of said roller when supported in said bearing means, said fluid passing through said orifice means prior to impinging on said roller; said bearing means including an axially slidable conically-shaped bearing member urged against one end of said roller by spring means; a threaded end cap supporting said bearing member and held within a threaded opening in one end of said housing; cover means on said housing for admitting said roller in the interior thereof and closing said housing prior to applying cleaning fluid to said roller; slot means in said threaded cap for admitting a handle attached to said paint roller; and closure means for sealingly covering said slot means for admitting said handle; said orifice means being mounted above the axis of rotation of said roller means on said bearing means and extending along substantially the full length of said roller.

* * * * *